US010895161B2

(12) United States Patent
Vogiatzis et al.

(10) Patent No.: US 10,895,161 B2
(45) Date of Patent: Jan. 19, 2021

(54) GAS TURBINE ENGINE AIRFOILS HAVING MULTIMODAL THICKNESS DISTRIBUTIONS

(71) Applicant: HONEYWELL INTERNATIONAL INC., Morris Plains, NJ (US)

(72) Inventors: Constantinos Vogiatzis, Gilbert, AZ (US); Yoseph Gebre-Giorgis, Phoenix, AZ (US)

(73) Assignee: HONEYWELL INTERNATIONAL INC., Charlotte, NC (US)

( * ) Notice: Subject to any disclaimer, the term of this patent is extended or adjusted under 35 U.S.C. 154(b) by 416 days.

(21) Appl. No.: 15/338,026

(22) Filed: Oct. 28, 2016

(65) Prior Publication Data

US 2018/0119555 A1 May 3, 2018

(51) Int. Cl.

| | |
|---|---|
| ***F01D 9/04*** | (2006.01) |
| ***F01D 5/16*** | (2006.01) |
| ***F01D 5/14*** | (2006.01) |

(52) U.S. Cl.

CPC ..... *F01D 9/041* (2013.01); *F01D 5/141* (2013.01); *F01D 5/16* (2013.01); *F05D 2220/32* (2013.01); *F05D 2240/121* (2013.01); *F05D 2240/122* (2013.01); *F05D 2240/123* (2013.01); *F05D 2240/124* (2013.01); *F05D 2240/125* (2013.01);

(Continued)

(58) Field of Classification Search

CPC ..... F01D 5/141; F01D 5/16; F01D 9/041

See application file for complete search history.

(56) References Cited

U.S. PATENT DOCUMENTS

| | | | | |
|---|---|---|---|---|
| 3,012,709 A | | 12/1961 | Schnell | |
| 4,108,573 A | * | 8/1978 | Wagner | F01D 5/141 416/236 A |

(Continued)

FOREIGN PATENT DOCUMENTS

| | | |
|---|---|---|
| EP | 1510652 A2 | 3/2005 |
| EP | 2816430 A1 | 12/2014 |
| GB | 2403779 A | 1/2005 |

OTHER PUBLICATIONS

Extended EP Search Report for Application No. 17197885.1 dated Mar. 7, 2018.

*Primary Examiner* — Ninh H. Nguyen
*Assistant Examiner* — Aye S Htay
(74) *Attorney, Agent, or Firm* — Lorenz & Kopf, LLP

(57) ABSTRACT

Gas turbine engine (GTE) airfoils, such as rotor and turbofan blades, having multimodal thickness distributions are provided. In one embodiment, the GTE airfoil includes an airfoil tip, an airfoil root opposite the airfoil tip in a spanwise direction, and first and second airfoil halves extending between the airfoil tip and the airfoil root. The first airfoil half has a first multimodal thickness distribution, as taken in a cross-section plane extending in the spanwise direction and in a thickness direction substantially perpendicular to the spanwise direction. The first multimodal thickness distribution may be defined by multiple locally-thickened airfoil regions, which are interspersed with multiple locally-thinned airfoil regions. The second airfoil half may or may not have a multimodal thickness distribution. By imparting at least one airfoil half with such a multimodal thickness distribution, targeted mechanical properties of the GTE airfoil may be enhanced with relatively little impact on aerodynamic performance.

16 Claims, 7 Drawing Sheets

(52) U.S. Cl.
CPC .. *F05D 2240/305* (2013.01); *F05D 2240/306* (2013.01); *F05D 2250/711* (2013.01); *F05D 2260/941* (2013.01)

(56) References Cited

U.S. PATENT DOCUMENTS

| | | | | |
|---|---|---|---|---|
| 5,395,071 | A | 3/1995 | Felix | |
| 6,358,012 | B1 * | 3/2002 | Staubach | F01D 5/141 416/228 |
| 6,565,324 | B1 | 5/2003 | Phillipsen et al. | |
| 6,837,679 | B2 * | 1/2005 | Kawarada | F01D 5/141 415/191 |
| 6,905,309 | B2 | 6/2005 | Nussbaum et al. | |
| 7,090,463 | B2 * | 8/2006 | Milburn | F01D 5/147 415/211.2 |
| 8,393,872 | B2 | 3/2013 | Kirtley | |
| 9,046,111 | B2 | 6/2015 | Harvey et al. | |
| 9,188,017 | B2 * | 11/2015 | Xu | F01D 9/041 |
| 10,408,070 | B2 | 9/2019 | Mahias et al. | |
| 2011/0097210 | A1 * | 4/2011 | Kirtley | F01D 5/141 416/223 A |
| 2011/0206527 | A1 | 8/2011 | Harvey et al. | |
| 2012/0061522 | A1 | 3/2012 | Sullivan et al. | |
| 2013/0164488 | A1 | 6/2013 | Wood et al. | |
| 2015/0354367 | A1 | 12/2015 | Gallagher et al. | |
| 2016/0024930 | A1 | 1/2016 | Aaron et al. | |
| 2016/0146012 | A1 | 5/2016 | Warikoo et al. | |
| 2017/0234134 | A1 | 8/2017 | Bunker | |

* cited by examiner

GAS TURBINE ENGINE AIRFOILS HAVING MULTIMODAL THICKNESS DISTRIBUTIONS

TECHNICAL FIELD

The following disclosure relates generally to gas turbine engines and, more particularly, to gas turbine engine airfoils having multimodal thickness distributions, such as gas turbine engine blades having multimodal spanwise thickness distributions.

BACKGROUND

A Gas Turbine Engine (GTE) contains multiple streamlined, airfoil-shaped parts or structures. Such structures are generally referred to herein as "GTE airfoils" and include compressor blades, turbine blades, turbofan blades, propeller blades, nozzle vanes, and inlet guide vanes, to list but a few examples. By common design, a GTE airfoil is imparted with a spanwise thickness distribution that gradually decreases, in a monotonic manner, when moving from a global maximum thickness located at the base or root of the airfoil to a global minimum thickness located at the airfoil tip. Similarly, the chordwise thickness of a GTE airfoil typically decreases monotonically when moving from a maximum global thickness located near the leading edge of the airfoil toward either the leading or trailing edge of the airfoil. GTE airfoils having such monotonic thickness distributions are more specifically referred to herein as "monotonic GTE airfoils."

Monotonic GTE airfoils provide a number of advantages. Such airfoils tend to perform well from an aerodynamic perspective and are amenable to fabrication utilizing legacy manufacturing processes, such as flank milling. Monotonic GTE airfoils are not without limitations, however. In certain instances, monotonic airfoils may perform sub-optimally in satisfying the various, often conflicting mechanical constraints encountered in the GTE environment. Additionally, the mechanical attributes of monotonic GTE airfoils are inexorably linked to the global average thickness and, therefore, the mass of the airfoil. A weight penalty is thus incurred if the global average thickness of a monotonic GTE airfoil is increased to, for example, enhance a particular mechanical attribute of the airfoil, such as the ability of the airfoil to withstand heighted stress concentrations and/or high impact forces (e.g., bird strike) without fracture or other structural compromise.

BRIEF SUMMARY

Gas turbine engine (GTE) airfoils, such as rotor and turbofan blades, having multimodal thickness distributions are provided. In one embodiment, the GTE airfoil includes an airfoil tip, an airfoil root opposite the airfoil tip in a spanwise direction, and first and second airfoil halves extending between the airfoil tip and the airfoil root. The first airfoil half has a first multimodal thickness distribution, as taken in a cross-section plane extending in the spanwise direction and in a thickness direction substantially perpendicular to the spanwise direction. The first multimodal thickness distribution may be defined by multiple locally-thickened airfoil regions, which are interspersed with multiple locally-thinned airfoil regions and through which the cross-section plane extends. The second airfoil half may have a second multimodal thickness distribution, which may or may not mirror the first multimodal thickness distribution.

Alternatively, the second airfoil half may have a non-multimodal thickness distribution, such as a monotonic thickness distribution. By imparting at least one airfoil half with such a multimodal thickness distribution, targeted mechanical properties of the GTE airfoil may be enhanced with relatively little impact on the aerodynamic performance of the airfoil.

In another embodiment, the GTE airfoil includes an airfoil tip and an airfoil root, which is spaced from the airfoil tip in a spanwise direction. A first airfoil half extends between the airfoil tip and the airfoil root in the spanwise direction and has an average or mean global thickness ($T_{GLOBAL_AVG}$). The GTE airfoil further includes a first locally-thickened region having a first maximum thickness ($T_{MAX1}$) greater than $T_{GLOBAL_AVG}$ and a second locally-thickened region having a second maximum thickness ($T_{MAX2}$) greater than $T_{MAX1}$. A first locally-thinned region is located between the first and second locally-thickened regions in the spanwise direction. The first locally-thinned region has a minimum thickness ($T_{MIN1}$) less than $T_{MAX1}$ and, perhaps, less than $T_{GLOBAL_AVG}$.

In a further embodiment, the GTE airfoil includes a leading edge, a trailing edge substantially opposite the leading edge in a chordwise direction, and a first airfoil half extending from the leading edge to the trailing edge. The first airfoil half has a first multimodal thickness profile, as considered in cross-section taken along a first cross-section plane extending in a thickness direction perpendicular to the chordwise direction. Stated differently, the first airfoil half may have a spanwise multimodal thickness profile, a chordwise multimodal thickness profile, or both. The first multimodal thickness profile includes at least three local thickness maxima interspersed with at least two local thickness minima. In one implementation wherein the first cross-plane extends in the thickness and spanwise directions, the first airfoil half may further include a second multimodal thickness profile, as considered in cross-section taken along a second cross-section plane extending in the thickness direction and a spanwise direction orthogonal to the thickness and spanwise directions.

BRIEF DESCRIPTION OF THE DRAWINGS

At least one example of the present invention will hereinafter be described in conjunction with the following figures, wherein like numerals denote like elements, and.

DETAILED DESCRIPTION

The following Detailed Description is merely exemplary in nature and is not intended to limit the invention or the application and uses of the invention. The term "exemplary," as appearing throughout this document, is synonymous with the term "example" and is utilized repeatedly below to emphasize that the description appearing in the following section merely provides multiple non-limiting examples of the invention and should not be construed to restrict the scope of the invention, as set-out in the Claims, in any respect.

Figure 1:
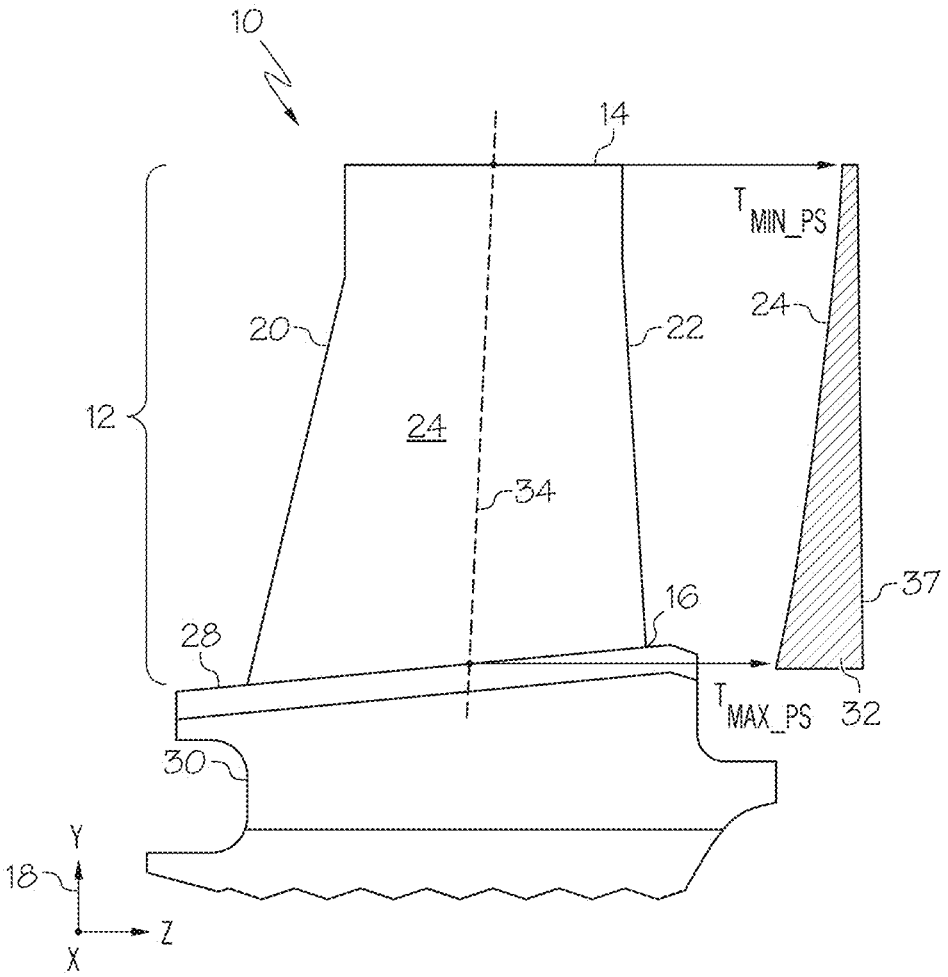
FIG. 1 (PRIOR ART)
FIGS. 1 and 2 are opposing side views of a Gas Turbine Engine (GTE) airfoil structure (here, a rotor blade structure) having monotonic thickness distributions in chordwise and spanwise directions, as shown in conjunction with associated cross-sectional views through the airfoil thickness and illustrated in accordance with the teachings of prior art.
Figure 2:
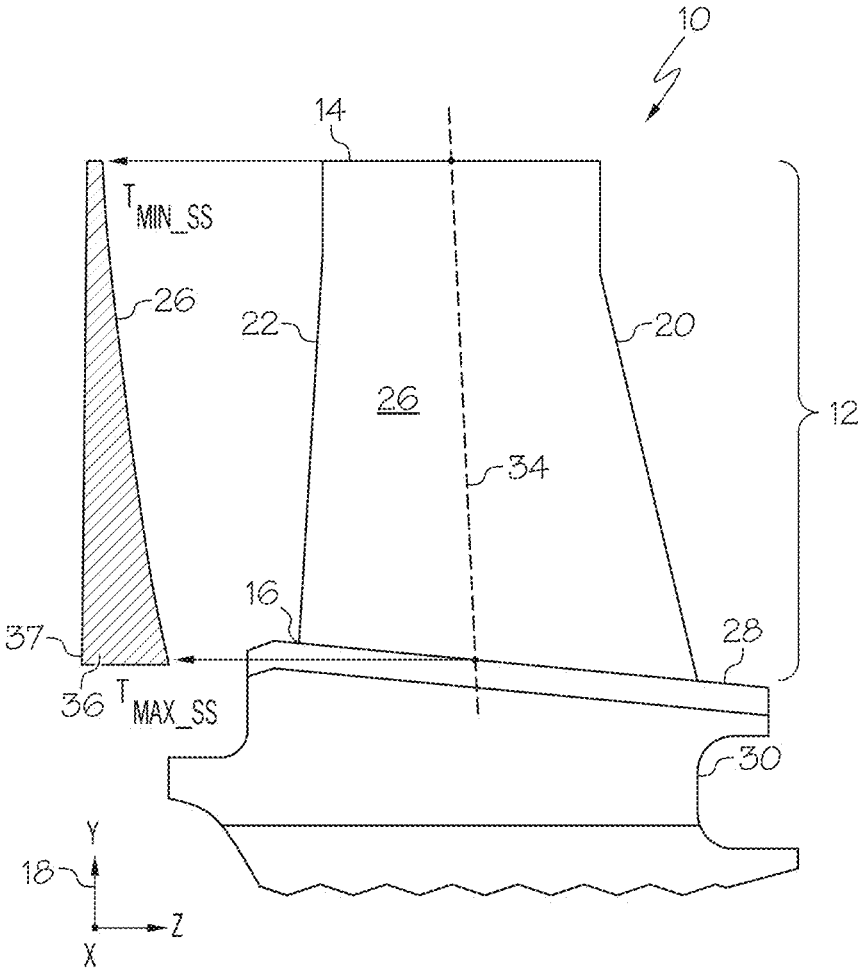
FIG. 2 (PRIOR ART)

As discussed above, gas turbine engine (GTE) airfoils are conventionally imparted with monotonic thickness distributions in both spanwise and chordwise directions. With respect to the airfoil thickness distribution in the spanwise direction, in particular, a GTE airfoil may taper monotonically from a global maximum thickness located at the airfoil base or root to a global maximum thickness located at the airfoil tip. Further illustrating this point, FIGS. 1 and 2 depict a conventional GTE airfoil structure 10 including an airfoil portion 12, which is shown in a meridional or flattened state. In this particular example, GTE airfoil structure 10 is a rotor blade piece and airfoil portion 12 is a rotor blade; consequently, GTE airfoil structure 10 and airfoil portion 12 are referred to hereafter as "rotor blade structure 10" and "rotor blade 12," respectively. As can be seen, rotor blade 12 includes a blade tip 14 and a blade root 16, which are spaced in a blade height or spanwise direction. The spanwise direction generally corresponds to the Y-axis identified by coordinate legend 18 appearing in the lower left corner of FIGS. 1 and 2.

Rotor blade 12 further includes a leading edge 20, a trailing edge 22, a first principal face or "pressure side" 24 (shown in FIG. 1), and a second principal face or "suction side" 26 (shown in FIG. 2). Pressure side 24 and suction side 26 are opposed in a thickness direction, which generally corresponds to the X-axis of coordinate legend 18 in the meridional views of FIGS. 1 and 2. Pressure and suction sides 24, 26 extend from leading edge 20 to trailing edge 22 in a chordwise direction, which generally corresponds to the Z-axis of coordinate legend 18. In the illustrated example, rotor blade structure 10 further includes a platform 28 and a shank 30, which is partially shown and joined to platform 28 opposite blade 12. In certain embodiments, rotor blade structure 10 may be a discrete, insert-type blade piece, and shank 30 may be imparted with an interlocking shape for mating insertion into a corresponding slot provided in a separately-fabricated rotor hub (not shown). In other embodiments, rotor blade structure 10 may assume various other forms such that rotor blade 12 is integrally formed with or otherwise joined to a rotor hub as, for example, a blisk. Rotor blade 12 may or may not be cambered and/or symmetrical.

Rotor blade 12 may be conceptually divided into a pressure side blade half and an opposing suction side blade half, which are joined along an interface represented by vertical lines 37 in the below-described cross-sectional views of FIGS. 1 and 2. When rotor blade 12 is cambered, the interface between the blade halves may generally correspond to the camber line, as extended through rotor blade 12 from blade tip 14 to blade root 16. FIG. 1 further depicts a cross-sectional view of the pressure side blade half (identified by reference numeral "32"), as taken along a cross-section plane extending in thickness and spanwise directions (represented by dashed line 34 and generally corresponding to an X-Y plane through the meridional view of rotor blade 12). Similarly, FIG. 2 sets-forth a cross-sectional view of the suction side blade half (identified by reference numeral "36"), as further taken along cross-section plane 34. Cross-section plane 34 extends through a middle portion of rotor blade 12 generally centered between leading edge 20 and trailing edge 22. The cross-sectional views shown in FIGS. 1 and 2 are not drawn to scale with certain dimensions exaggerated to more clearly illustrate variations in blade thickness.

Referring initially to the cross-section of FIG. 1, pressure side blade half 32 has a monotonic spanwise thickness distribution; that is, a thickness distribution lacking multiple interspersed local minima and maxima, as considered in the spanwise direction. As indicated on the right side of FIG. 1, the thickness of pressure side blade half 32 gradually decreases from a global maximum thickness located at blade root 16 (identified as "$T_{MAX_PS}$") to a global minimum thickness located at blade tip 14 (identified as "$T_{MIN_PS}$"), both thicknesses taken in cross-section plane 34. The spanwise thickness distribution of suction side blade half 36 is also monotonic and may mirror the spanwise thickness distribution of pressure side blade half 32. Accordingly, and as can be seen in the cross-section appearing on the left side of FIG. 2, suction side blade half 36 has a monotonic spanwise thickness distribution, which decreases from a global maximum thickness at blade root 16 (identified as "$T_{MAX_SS}$") in cross-section plane 34 to a global minimum thickness at blade tip 14 (identified as "$T_{MIN_SS}$"). Blade halves 32, 36 are thus each produced to have a monotonic thickness distribution in a spanwise direction, as taken along cross-section plane 34. Blade halves 32, 36 also have monotonic spanwise thickness distributions taken along other, non-illustrated cross-section planes extending parallel to plane 34, although the monotonic spanwise thickness distributions of blade halves 32, 36 taken along other planes may vary in relative dimensions. In a similar regard, blade halves 32, 36 (and, more generally, rotor blade 12) may also be imparted with monotonic thicknesses distribution in chordwise directions. For example, blades halves 32, 36 may each have a maximum global thickness, which is located near, but offset from leading edge 20; and which decreases monotonically when moving in a chordwise direction toward either leading edge 20 or trailing edge 22.

Several benefits may be achieved by imparting a GTE airfoil, such as rotor blade 12, with relatively non-complex, monotonic thickness distributions in the chordwise and spanwise directions. Generally, GTE airfoils having monotonic thickness distributions provide high levels of aerodynamic performance, are relatively straightforward to model and design, and are amenable to production utilizing legacy fabrication processes, such as flank milling. These advantages notwithstanding, the present inventors have recognized that certain benefits may be obtained by imparting GTE airfoils with non-monotonic thickness distributions and, specifically, with multimodal thickness distributions in at least spanwise directions. Traditionally, such a departure from monotonic airfoil designs may have been discouraged by concerns regarding excessive aerodynamic penalties and other complicating factors, such as manufacturing and design constraints. The present inventors have determined, however, that GTE airfoils having such multimodal thickness distributions (e.g., in the form of strategically positioned and shaped regions of locally-increased and locally-decreased thicknesses) can obtain certain notable benefits from mechanical performance and weight savings perspectives, while incurring little to no degradation in aerodynamic performance of the resulting airfoil.

Benefits that may be realized by imparting GTE airfoils with tailored multimodal thickness distributions may include, but are not limited to: (i) shifting of the vibrational response of the airfoil to excitation modes residing outside of the operational frequency range of a particular GTE or at least offset from the primary operational frequency bands of the GTE containing the GTE airfoil, (ii) decreased stress concentrations within localized regions of the airfoil during GTE operation, and/or (iii) increased structural robustness in the presence of high impact forces, as may be particularly beneficial when the airfoil assumes the form of a turbofan blade, a propeller blade, or a rotor blade of an early stage axial compressor susceptible to bird strike. As a still further advantage, imparting a GTE airfoil with such a tailored multimodal thickness distribution can enable the GTE airfoil to satisfy performance criteria at a reduced volume and weight. While it may be possible to boost fracture resistance in the event of high force impact by increasing the mean global thickness of a GTE airfoil having a monotonic thickness distribution, doing so inexorably results in an increase in the overall weight of the individual airfoil. Such a weight penalty may be significant when considered cumulatively in the context of a GTE component containing a relatively large number of airfoils. In contrast, the strategic localized thickening of targeted airfoil regions to boost high impact force fracture resistance (and/or other mechanical attributes of the airfoil), and/or the strategic localized thinning of airfoil regions having a lesser impact on the mechanical properties of the airfoil, can produce a light-weight GTE airfoil having enhanced mechanical properties, while also providing aerodynamic performance levels comparable to those of conventional monotonic GTE airfoils.

Figure 3:
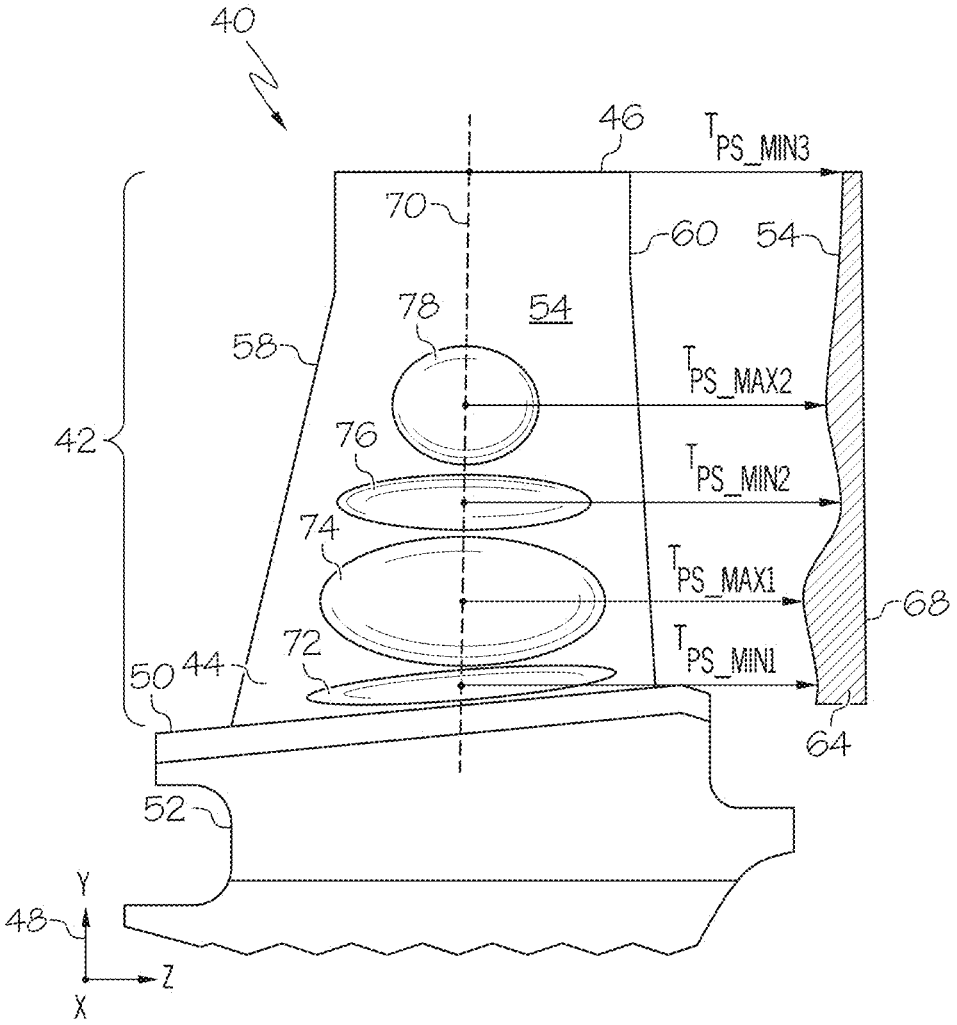
FIGS. 3 and 4 are opposing side views of a GTE airfoil structure having a multimodal thickness distribution in at least an airfoil height or spanwise direction, as shown in conjunction with associated cross-sectional views through the airfoil thickness and illustrated in accordance with an exemplary embodiment of the present disclosure.
Figure 4:
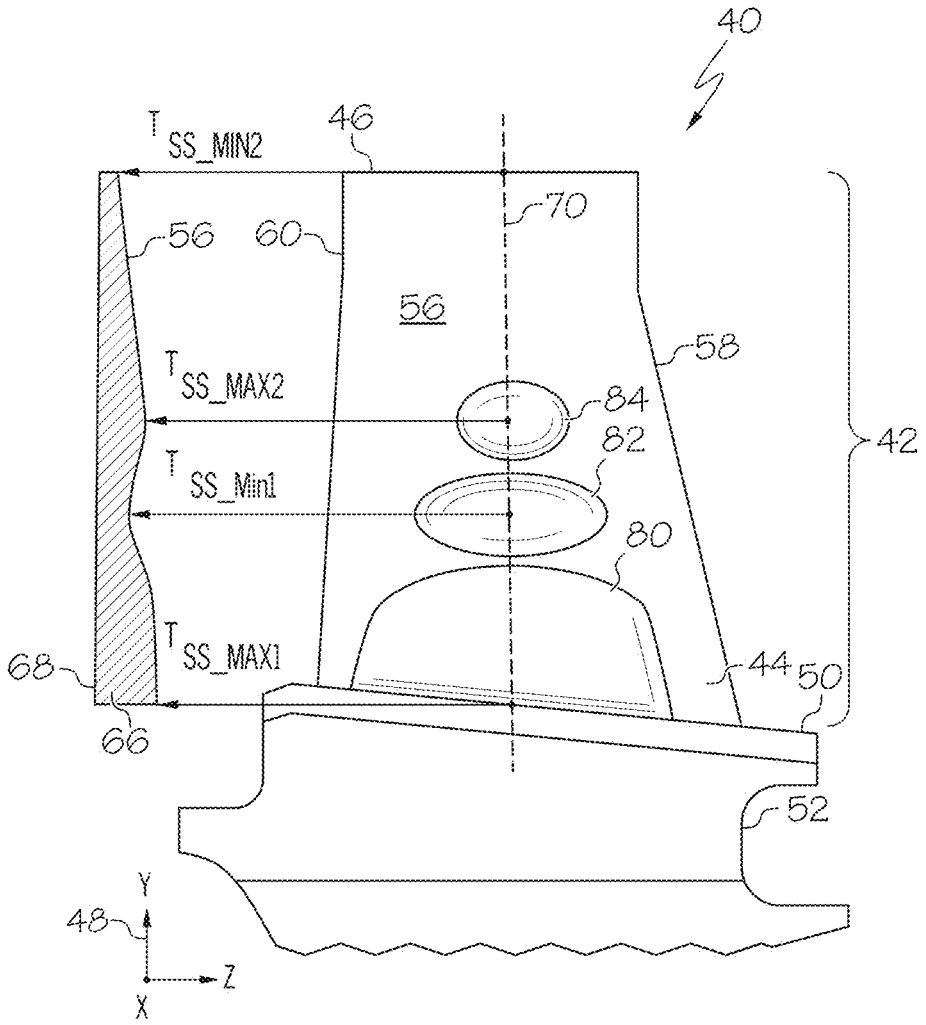
Figure 5:
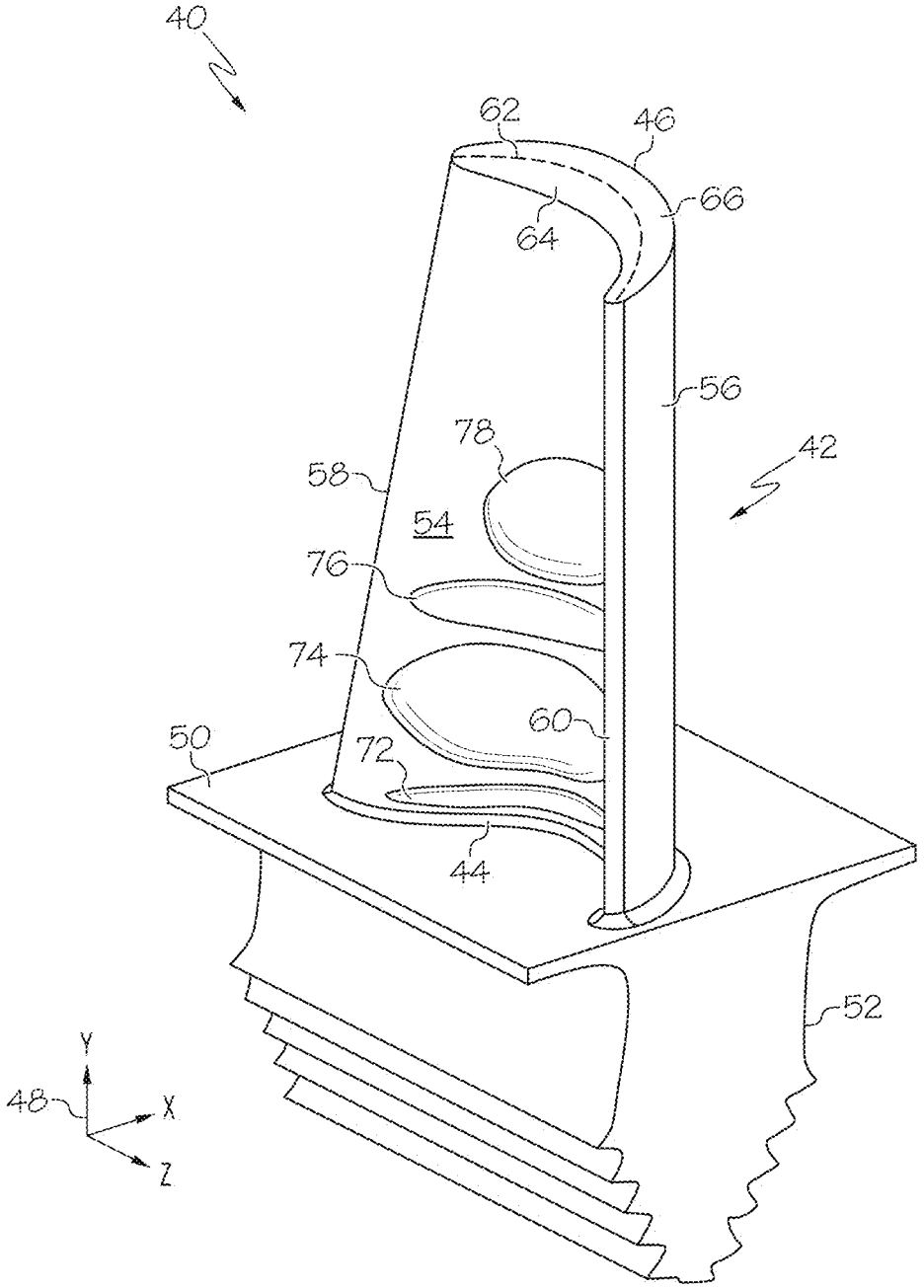
FIG. 5 is an isometric view of the exemplary GTE airfoil shown in FIGS. 3 and 4.

Turning now to FIGS. 3-5, there is shown a GTE airfoil structure 40 including a GTE airfoil 42, as illustrated in accordance with an exemplary embodiment of the present disclosure. In certain respects, GTE airfoil structure 40 is similar to conventional GTE airfoil structure 10 discussed above in conjunction with FIGS. 1 and 2. For example, as was previously the case, GTE airfoil structure 40 assumes the form of a rotor blade structure and will consequently be referred to as "rotor blade structure 40" hereafter, while GTE airfoil 42 is referred to as "rotor blade 42." The instant example notwithstanding, it is emphasized that the following description is equally applicable to other types of GTE airfoils, without limitation, including other types of rotor blades included in axial compressors, impellers, axial turbines, or radial turbines; turbofans blades; propeller blades; and static GTE vanes, such as turbine nozzle vanes and inlet guide vanes.

Rotor blade 42 includes a blade root 44 and an opposing blade tip 46. Blade tip 46 is spaced from blade root 44 in a blade height or spanwise direction, which generally corresponds to the Y-axis of coordinate legend 48 in the meridional views of FIGS. 3 and 4, as well as in the isometric view of FIG. 5. Blade root 44 is joined (e.g., integrally formed with) a platform 50 further included in rotor blade structure 40. Rotor blade 42 thus extends from platform 50 in the spanwise direction and terminates in blade tip 46. Opposite rotor blade 42, platform 50 is joined to (e.g., integrally formed with) a base portion or shank 52 of rotor blade structure 40. Rotor blade 42 further includes a first principal face or "pressure side" 54 and a second, opposing face or "suction side 56." Pressure side 54 and suction side 56 extend in a chordwise direction and are opposed in a thickness direction (generally corresponding to the Z- and X-axes of coordinate legend 48, respectively, in the meridional views of FIGS. 3 and 4). Pressure side 54 and suction side 56 extend from a leading edge 58 to a trailing edge 60 of rotor blade 42. In the illustrated example, rotor blade 42 is somewhat asymmetrical and cambered, as shown most clearly in FIG. 5 (noting dashed camber line 62 extending along blade tip 46). Pressure side 54 thus has a contoured, generally concave surface geometry, which gently bends or curves in three dimensions. Conversely, suction side 56 has a countered, generally convex surface geometry, which likewise bends or curves in multiple dimensions. In further embodiments, rotor blade 42 may not be cambered and may be either symmetrical or asymmetrical.

As shown most clearly in FIG. 5, shank 52 may be produced to have an interlocking geometry, such as a fir tree or dovetail geometry. When rotor blade structure 40 is assembled into a larger rotor, shank 52 is inserted into mating slots provided around an outer circumferential portion of a separately-fabricated hub disk to prevent disengagement of blade structure 40 during high speed rotation of the rotor. In other implementations, rotor blade structure 40 may be joined (e.g., via brazing, diffusion bonding, or the like) to a plurality of other blade structures to yield a blade ring, which is then bonded to a separately-fabricated hub disk utilizing, for example, a Hot Isostatic Pressing (HIP) process. As a still further possibility, a rotor can be produced to include a number of blades similar to blade 42, but integrally produced with the rotor hub as a single (e.g., forged and machined) component or blisk. Generally, then, it should be understood that rotor blade structure 40 is provided by way of non-limiting example and that blade structure 40 (and the other airfoil structures described herein) can be fabricated utilizing various different manufacturing approaches. Such approaches may include, but are not limited to, casting and machining, three dimensional metal printing processes, direct metal laser sintering, Computer Numerical Control (CNC) milling of a preform or blank, and powder metallurgy, to list but a few examples.

As was previously the case, rotor blade 42 can be conceptually divided into two opposing halves: i.e., a pressure side blade half 64 and a suction side blade half 66. Pressure side blade half 64 and a suction side blade half 66 are opposed in a thickness direction (again, corresponding to the X-axis of coordinate legend 48 for the meridional views of FIGS. 3 and 4). Blade halves 64, 66 may be integrally formed as a single part or monolithic piece such that the division or interface between blade halves 64, 66 is a conceptual boundary, rather than a discrete physical boundary; however, the possibility that blade halves 64, 66 may be separately fabricated (e.g., cast) and then joined in some manner is by no means precluded. Additionally, it should be appreciated that the boundary or interface between blade halves 64, 66 need not precisely bisect rotor blade 42. Accordingly, the term "half," as appearing in this document, is utilized in a generalized sense to indicate that blade 42 can be divided in two portions along an interface generally extending in the spanwise and chordwise directions. In an embodiment, blade halves 64, 66 may have approximately equivalent volumes; that is, volumes that differ by no more than 10%. In the illustrated example, pressure side blade half 64 may generally correspond to the portion of rotor blade 42 bounded by pressure side 54 and camber line 62 (FIG. 5), as extended through blade 42 from blade root 44 to blade tip 46. Conversely, suction side blade half 66 may generally correspond to the portion of rotor blade 42 bounded by suction side 56 and camber line 62, as extended through blade 42 from root 44 to tip 46.

FIGS. 3 and 4 further provide cross-sectional views of pressure side blade half 64 and suction side blade halve 66, respectively, as taken along a cross-section plane extending in thickness and spanwise directions (represented by dashed line 70 and generally corresponding to an X-Y plane in the illustrated meridional views). As described below, cross-section plane 70 extends through a middle or intermediate portion of rotor blade 42 generally centered between leading edge 58 and trailing edge 60 of blade 42. For example, in an embodiment, cross-section plane 70 may transect a midpoint located substantially equidistantly between leading edge 58 and trailing edge 60, as taken along either blade tip 46 or along blade root 44. Description will now be provided regarding various thicknesses of pressure side blade half 64 and suction side blade half 66. For the purposes of this document, when referring to the thicknesses of a blade (or airfoil) half, the blade (or airfoil) thicknesses are measured from the interface or boundary between blade (or airfoil) halves to the outer principal surface of the corresponding blade (or airfoil) half. As an example, in the case of pressure side blade half 64, blade thicknesses are measured from the boundary between blade halves 64, 66 (corresponding to vertical line 68 in the cross-sections of FIGS. 3 and 4) to suction side 54. The cross-sectional views of FIGS. 3 and 4 are not drawn to scale, and the differences between the below-described local thickness maxima and minima may be exaggerated for illustrative clarity.

Referring to the cross-section of FIG. 3, pressure side blade half 64 is imparted with a multimodal spanwise thickness distribution; the term "multimodal spanwise thickness distribution" referring to a thickness distribution including multiple interspersed local minima and maxima, as taken in a spanwise direction. More specifically, pressure side blade half 64 has a multimodal spanwise thickness distribution including two local thickness maxima (identified as "$T_{PS_MAX1}$" and "$T_{PS_MAX2}$") interspersed with three local thickness minima (identified as "$T_{PS_MIN1}$," "$T_{PS_MIN2}$," and "$T_{PS_MIN3}$"). As taken within cross-section plane 70, and moving from blade root 44 outwardly toward blade tip 46, the thickness of pressure side blade half 64 initially increases from a first local thickness minimum located at or adjacent blade root 44 ($T_{PS_MIN1}$) to a first local thickness maximum ($T_{PS_MAX1}$) located slightly outboard (that is, toward blade tip 46) of $T_{PS_MIN1}$. In one embodiment, $T_{PS_MAX1}$ may be located between approximately a 10% to 30% span of rotor blade 42, as measured in the spanwise direction and increasing in percentage with increasing proximity to blade tip 46. Moving further toward blade tip 46, the thickness of pressure side blade half 64 then decreases from $T_{PS_MAX1}$ to a second local thickness minimum ($T_{PS_MIN2}$) located approximately between a 30% to 50% span of rotor blade 42. Next, the thickness of pressure side blade half 64 again increases from $T_{PS_MIN2}$ to a second local thickness maximum ($T_{PS_MAX2}$) located approximately between a 50% to 70% span of blade 42. Finally, the thickness of pressure side blade half 64 again decreases from $T_{PS_MAX2}$ to a third local thickness minimum ($T_{PS_MIN3}$) located at blade tip 46 (100% span).

Pressure side blade half 64 further has a global mean or average thickness ($T_{PS_GLOBAL_AVG}$), as taken across the entirety of blade half 64 in the thickness direction (again, corresponding to the X-axis of coordinate legend 48 for the meridional views of FIGS. 3 and 4). The relative dimensions of $T_{PS_GLOBAL_AVG}$, the local thickness maxima taken in cross-section plane 70 ($T_{PS_MAX1\text{-}2}$) and elsewhere across pressure side blade half 64, and the local thickness minima taken in plane 70 ($T_{PS_MIN1\text{-}3}$) and elsewhere across blade half 64 will vary amongst embodiments and may be tailored to best suit a particular application by, for example, fine tuning targeted mechanical properties of rotor blade structure 40 in the below-described manner. To provide a useful, but non-limiting example, $T_{PS_MAX1}$ may be greater than $T_{PS_MAX2}$, which may, in turn, be greater than $T_{PS_GLOBAL_AVG}$ in an embodiment. Additionally, $T_{PS_MIN1}$ may be greater than $T_{PS_MIN2}$, which may, in turn, be greater than $T_{PS_MIN3}$. In other embodiments, $T_{PS_MIN2}$ and $T_{PS_MIN3}$ may both be less than $T_{PS_GLOBAL_AVG}$, while $T_{PS_MIN1}$ may or may not be less than $T_{PS_GLOBAL_AVG}$. In further implementations, $T_{PS_MAX1}$ may be at least twice the minimum local thickness at blade tip 46 ($T_{PS_MAX1}$). The thickness profile of blade 42 may vary taken along other section planes parallel to cross-section plane 70, as considered for the meridional views of blade 42. For example, taken along a cross-section plane adjacent plane 70, blade 42 may have a similar multimodal thickness distribution, but with a lesser disparity in magnitude between $T_{PS_MAX1\text{-}2}$ and $T_{PS_MIN1\text{-}3}$. Furthermore, in certain embodiments, rotor blade 42 may have a monotonic thickness distribution taken along certain other cross-section planes, such as cross-sectional planes extending in spanwise and thickness directions and located at or adjacent leading edge 58 or trailing edge 60.

The above-described multimodal thickness distribution of pressure side blade half 64 may be defined by multiple locally-thickened and locally-thinned regions of rotor blade 42. These regions are generically represented in the meridional view of FIG. 3 by ovular symbols or graphics. Specifically, a first ovular graphic 72 represents a substantially concave, locally-thickened region of pressure side blade half 64, which generally centers around $T_{PS_MIN1}$ as its nadir. Similarly, a second ovular graphic 74 represents a substantially convex, locally-thinned region of pressure side blade half 64, which generally centers around in $T_{PS_MAX1}$ at its apex. A third ovular graphic 76 represents a substantially concave, locally-thinned region of blade half 64, which centers around $T_{PS_MIN2}$ as its nadir. Finally, a fourth ovular graphic 78 represents a generally convex, locally-thickened region of pressure side blade half 64, which culminates in $T_{PS_MAX2}$ at or near its centerpoint. Regions 72, 76 may thus be regarded as contoured valleys or depressions formed in suction side 54, while regions 74, 78 may be regarded as rounded peaks or hills. Regions 72, 74, 76, 78 are considered "locally-thinned" or "locally-thickened," as the case may be, relative to the respective thicknesses these regions would otherwise have if pressure side blade half 42 were imparted with a monotonic thickness distribution having maximum and minimum thicknesses equivalent to those of blade half 42. The transitions between the locally-thickened and locally-thinned regions 72, 74, 76, 78 are preferably characterized by relatively gradual, smooth, non-stepped surface geometries for optimal aerodynamic efficiency; however, the possibility that one or more stepped regions may be included in the surface contours of pressure side 54 in transition between regions 72, 74, 76, 78 is not precluded.

The selection of the particular regions of pressure side blade half 64 to locally thicken, the selection of the particular regions to locally thin, and manner in which to shape and dimension such thickness-modified regions can be determined utilizing various different design approaches, which may incorporate any combination of physical model testing, computer modeling, and systematic analysis of in-field failure modes. Generally, an approach may be utilized where regions of pressure side blade half 64 (or, more generally, blade 42) are identified as having a relatively pronounced or strong influence on one or more mechanical parameters of concern and are then targeted for local thickening. Additionally or alternatively, regions of blade half 64 (or, more generally, blade 42) may be identified having a less impactful or relatively weak influence on the mechanical parameters of concern and targeted for local thickness reduction. In the case of rotor blade 42, for example, it may be determined that region 76 has a pronounced influence on the ability of rotor blade 42 to withstand high force impact, such as bird strike, without fracture or other structural compromise. Region 76 may then be thickened by design to increase the mechanical strength of region 76 and, therefore, the overall ability of rotor blade 42 to resist structural compromise due to high force impact. As a second example, region 72 may be identified as a region subject to high levels of localized stress when rotor blade 42 operates in the GTE environment due to, for example, vibratory forces, centrifugal forces, localized heat concentrations, or the like. Thus, the thickness of region 72 may be increased to enhance the ability of region 72 to withstand such stress concentrations and/or to better distribute such mechanical stress over a broader volume of rotor blade 42.

The regions of pressure side blade half 64 identified as having a relatively low influence on the mechanical parameters of concern may be targeted for local thickness reduction. For example, and with continued reference to FIG. 3, regions 74, 78 may be identified as having relatively low stress concentrations and/or as relatively resistant to fracture in the event of high force impact. Material thickness may thus be removed from regions 74, 78 to reduce the overall volume and weight of rotor blade 42 with little to no impact on the mechanical performance of blade 42. Material thickness also may be removed from regions 74, 78 and/or material thickness may be added to regions 72, 76 to shift the vibratory response of rotor blade 42 to desirable frequencies and thereby further reduce mechanical stress within blade 42 when placed in the GTE operational environment. In this regard, regions 72, 74, 76, 78 may be locally-thinned or locally-thickened to shift the excitation or critical modes of rotor blade 42 to bands outside of the operation range of the host GTE and/or to bands that are less frequently encountered during GTE operation. As a relatively simple example, if rotor blade 42 (pre-thickness modification) were to experience significant resonance at a first frequency (e.g., 150 hertz) encountered at prolonged engine idle, the local thickening or thinning of rotor blade 42 may shift the resonance of blade 42 to a second frequency (e.g., 170 hertz) that is only temporary encountered when the engine transitions from idle to cruise.

Suction side blade half 66 may have a second spanwise multimodal thickness distribution, which may or may not mirror the spanwise multimodal thickness distribution of pressure side blade half 64. For example, suction side blade half 66 may have a spanwise multimodal thickness distribution that is similar to, but not identical to the multimodal thickness distribution of blade half 64; e.g., as indicated in FIG. 4, suction side blade half 66 may have a spanwise multimodal thickness distribution including two local thickness maxima ($T_{SS_MAX1\text{-}2}$) interspersed with two local thickness minima ($T_{SS_MAX1\text{-}2}$), as taken in cross-section plane 70. In this regard, and again moving outwardly from blade root 44 toward blade tip 46, the thickness of pressure side blade half 64 may initially decrease from a first local thickness maximum ($T_{SS_MAX1}$) to a first local thickness minimum ($T_{SS_MIN1}$), then increase from $T_{SS_MIN1}$ to a second local thickness maximum ($T_{SS_MAX2}$), and finally decrease from $T_{SS_MAX2}$ to the second local thickness minimum ($T_{SS_MIN2}$). As was previously the case, $T_{SS_MAX1\text{-}2}$ and $T_{SS_MIN1\text{-}2}$ may be defined by multiple interspersed locally-thickened and locally-thinned blade regions. These regions are identified in FIG. 4 by symbols 80, 82, 84, with symbols 80, 84 representing localized convex regions or rounded hills formed in suction side 56, and symbol 84 representing a localized concave region or valley in suction side 56 between locally-thickened regions 82, 84. As previously indicated, the locations, shape, and dimensions of regions 80, 82, 84 may be selected as a function of impact on mechanical performance; e.g., to allow a designer to satisfy mechanical criteria, while minimizing the overall volume and weight of rotor blade structure 40. In further embodiments, suction side blade half 66 may instead have a non-multimodal spanwise thickness distribution, such as a monotonic thickness distribution or a flat surface geometry. In yet other embodiments, suction side blade half 66 may have a multimodal spanwise thickness distribution, while pressure side blade half 64 has a non-multimodal spanwise thickness distribution.

The foregoing has thus provided embodiments of a GTE airfoil having a multimodal thickness distribution in at least a spanwise direction. As described above, the GTE airfoil may have a spanwise multimodal thickness distribution as taken along a cross-section plane extending through an intermediate portion of the airfoil and, perhaps, transecting a midpoint along the airfoil tip and/or the airfoil root. The multimodal thickness distribution may be defined by multiple locally-thickened regions interspersed with (e.g., alternating with) multiple locally-thinned regions of the region through which the cross-section plane extends. In the above-described example, the locally-thickened regions and locally-thinned regions are imparted with substantially radially symmetrical geometries (with the exception of locally-thickened region 80) and are generally concentrically aligned in the spanwise direction as taken along cross-section plane 70. In further embodiments, the GTE airfoil may include locally-thickened regions and/or locally-thinned regions having different (e.g., irregular or non-symmetrical) geometries and which may or may not concentrically align in a spanwise direction. Furthermore, embodiments of the GTE airfoil may be imparted with a multimodal thickness distribution in a chordwise direction. Further emphasizing this point, an additional embodiment of a GTE airfoil having more complex multimodal thickness distributions in both spanwise and chordwise directions will now be described in conjunction with FIGS. 6 and 7.

Figure 6:
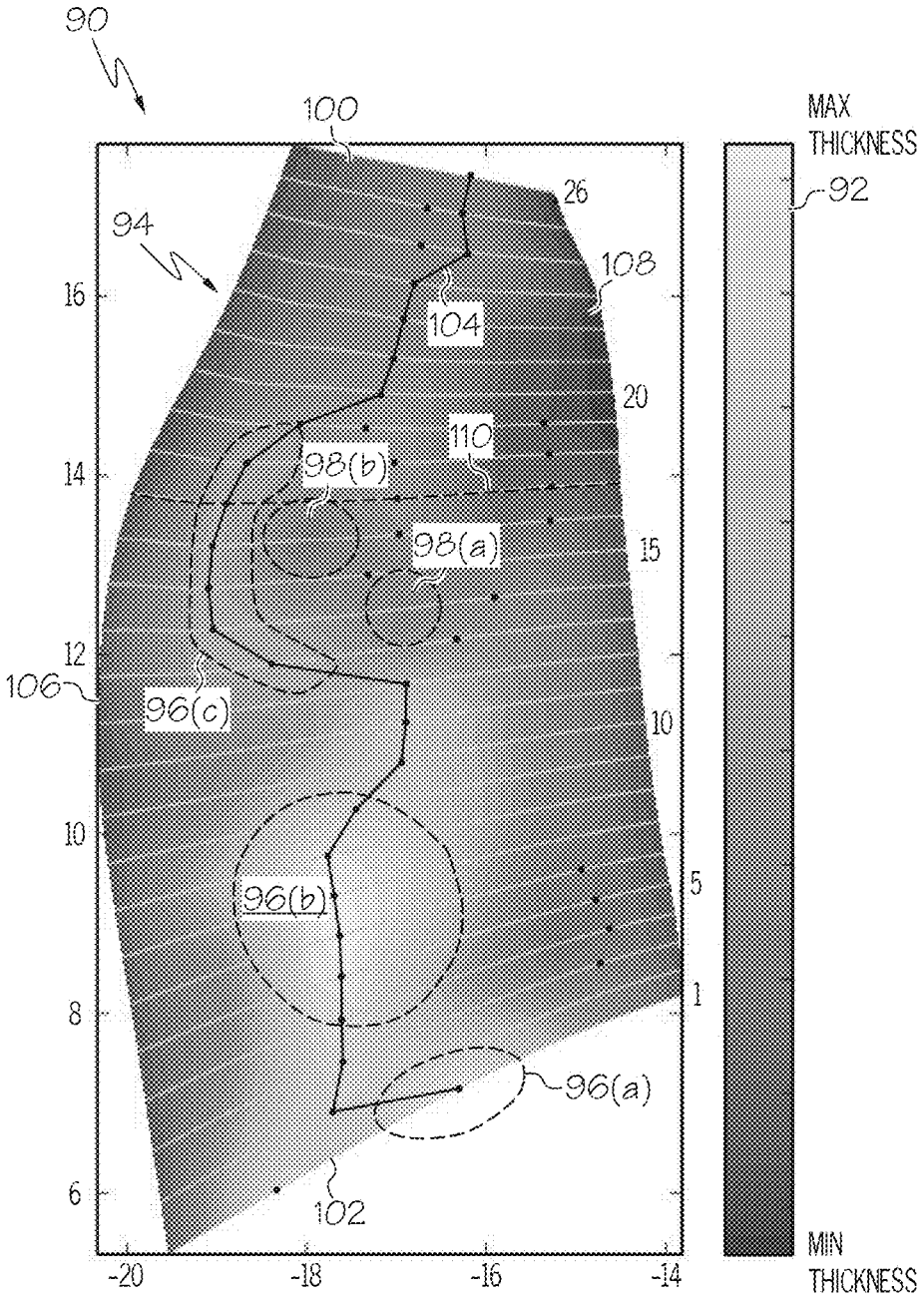
FIG. 6 is a meridional topographical view of a GTE airfoil including multimodal thickness distributions in spanwise and chordwise directions, as illustrated in accordance with a further exemplary embodiment of the present disclosure.

FIG. 6 is a meridional topographical view of a GTE airfoil 90 including multimodal thickness distributions in both spanwise and chordwise directions, as illustrated in accordance with a further exemplary embodiment of the present disclosure. GTE airfoil 90 can be, for example, a rotor blade, a turbofan blade, a propeller blade, a turbine nozzle vane, or an inlet guide vane. The illustrated thickness measurements are taken through a selected half 94 of GTE airfoil 90, which may represent either the suction side or pressure side half of airfoil 90. The opposing half of GTE airfoil 90 may have a similar multimodal thickness distribution, a different multimodal thickness distribution, or a non-multimodal thickness distribution. As indicated by a thickness key 92 appearing on the right side of FIG. 6, the local thickness of GTE airfoil half 94 fluctuates between a maximum global thickness ($T_{MAX_GLOBAL}$) and a minimum global thickness ($T_{MIN_GLOBAL}$). The particular values of $T_{MAX_GLOBAL}$ and $T_{MIN_GLOBAL}$ will vary amongst embodiments. However, by way of non-limiting example, $T_{MAX_GLOBAL}$ may be between about 0.35 and about 0.75 inch, while $T_{MIN_GLOBAL}$ is between about 0.2 and about 0.01 inch in an embodiment. In further embodiments, $T_{MAX}$ and $T_{MIN}$ may be greater than or less than the aforementioned ranges.

With continued reference to FIG. 6, GTE airfoil half 94 is imparted with a spanwise multimodal thickness distribution. In particular, GTE airfoil half 94 includes a number of locally-thickened regions identified by graphics 96(*a*)-(*c*), as well as a number of locally-thinned regions identified by graphics 98(*a*)-(*b*). A line 100 is overlaid onto the principal surface of GTE airfoil half 94 and connects the maximum global thickness for each chord of airfoil half 94 between airfoil root 102 and airfoil tip 104. Starting from airfoil root 98 and moving outwardly toward airfoil tip 100, chord-to-chord maximum global thickness line 96 initially moves toward leading edge 106 when transitioning between locally-thickened regions 96(*a*), 96(*b*); recedes toward trailing edge 108 when transitioning between locally-thickened regions 96(*b*), 96(*c*); then again advances toward leading edge 106 within the crescent-shaped locally-thickened region 96(*c*); and finally again recedes toward trailing edge 108 before reaching airfoil tip 100. The particular mechanical attributes enhanced by locally-thickened regions 96(*a*)-(*c*) may be interrelated such that each region 96(*a*)-(*c*) impacts multiple different mechanical parameters of GTE airfoil 90. However, in a highly generalized sense, relatively large locally-thickened region 96(*b*) and/or locally-thickened region 96(*a*) may favorably increase the fracture resistance of GTE airfoil half 94 when subject to bird strike or other high impact force; while locally-thickened region 96(*c*) may boost the ability of GTE airfoil 90 to withstand high stress concentrations in approximately the 40% to 80% span of airfoil 90 (or may better dissipate such stress concentrations over a larger volume of material). Comparatively, locally-thinned regions 98(*a*)-(*b*) may help reduce the overall weight of airfoil 90, while providing no or a nominal material detriment to the mechanical properties of airfoil 90. Any combination of regions 96(*a*)-(*c*), 98(*a*)-(*b*) may also serve to shift the vibrational modes of GTE airfoil 94 to preferred frequencies in the previously-described manner.

Figure 7:
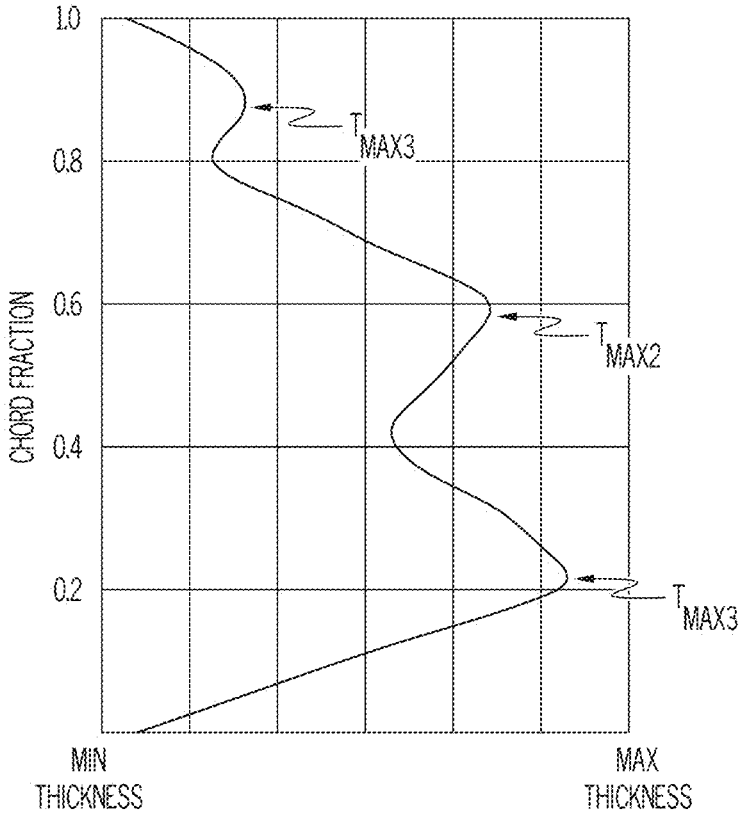
FIG. 7 is a graph of airfoil thickness (abscissa) versus chord fraction (ordinate) illustrating a spanwise multimodal thickness profile of the GTE airfoil shown in FIG. 6, as taken in a chordwise direction along a selected chord line (identified in FIG. 6) and including three local thickness maxima interspersed with multiple local thickness minima.

It should thus be appreciated that GTE airfoil half 94 is imparted with a spanwise multimodal thickness distribution, as taken along a number of (but not all) cross-section planes extending in a spanwise direction and a thickness direction (into the plane of the page in FIG. 6). Concurrently, GTE airfoil half 94 also has a multimodal thickness distribution in a chordwise direction, as taken along a number of (but not necessarily all) cross-section planes extending in chordwise and thickness directions. Consider, for example, the multimodal thickness distribution of GTE airfoil half 94, as taken along chord line 110 identified in FIG. 6 and graphically expressed in FIG. 7. Referring jointly to FIGS. 6 and 7, it can be seen that the spanwise thickness distribution of GTE airfoil half 94 along chord line 110 contains three local thickness maxima (identified in FIG. 7 as "$T_{MAX1\text{-}3}$"), which are interspersed with at least two (here, four) local thickness minima. The lower edge of the graph in FIG. 7 corresponds to leading edge 106 such that the maximum global thickness (in this example, $T_{MAX1}$) is located closer to leading edge 106 than to trailing edge 108. By imparting GTE airfoil half 94 with multimodal thickness distributions in both chordwise and spanwise directions in this manner, the airfoil designer is imparted with considerable flexibility to adjust the local thickness of GTE airfoil half 94 (and possibly the opposing airfoil half) as a powerful tool in simultaneously enhancing multiple, often conflicting mechanical properties of GTE airfoil 90 and/or in decreasing the volume and weight of airfoil 90, while maintaining relatively high levels of aerodynamic performance.

Multiple exemplary embodiment of GTE airfoils with tailored multimodal thickness distributions have thus been disclosed. In the foregoing embodiments, the GTE airfoils include multimodal thickness distributions in spanwise and/or in chordwise directions. The multimodal thickness distributions may be defined by regions of locally-increased thickness and/or locally-reduced thickness, which are formed across one or more principal surfaces (e.g., the suction side and/or the pressure side) of an airfoil. The number, disposition, shape, and dimensions of the regions of locally-increased thickness and/or locally-reduced thickness (and, thus, the relative disposition and disparity in magnitude between the local thickness maxima and minima) can be selected based on various different criteria to reduce weight and to fine tune mechanical parameters; e.g., to boost high impact force fracture resistance, to better dissipate stress concentrations, to shift critical vibrational modes, and the like. Thus, in a general sense, the multimodal thickness distribution of the GTE airfoil can be tailored, by design, to selectively affect only or predominately those airfoil regions determined to have a relatively high influence on targeted mechanical properties thereby allowing an airfoil designer to satisfy mechanical goals, while minimizing weight and aerodynamic performance penalties. While described above in conjunction with a particular type of GTE airfoil, namely, a rotor blade, it is emphasized that embodiments of the GTE airfoil can assume the form of any aerodynamically streamlined body or component included in a GTE and having an airfoil-shaped surface geometry, at least in predominate part, including both rotating blades and static vanes.

While at least one exemplary embodiment has been presented in the foregoing Detailed Description, it should be appreciated that a vast number of variations exist. It should also be appreciated that the exemplary embodiment or exemplary embodiments are only examples, and are not intended to limit the scope, applicability, or configuration of the invention in any way. Rather, the foregoing Detailed Description will provide those skilled in the art with a convenient road map for implementing an exemplary embodiment of the invention. Various changes may be made in the function and arrangement of elements described in an exemplary embodiment without departing from the scope of the invention as set-forth in the appended Claims.

What is claimed is:

1. A gas turbine engine airfoil, comprising:

an airfoil tip;

an airfoil root opposite the airfoil tip in a spanwise direction, with a span 0% at the root and 100% at the tip;

a leading edge;

a trailing edge spaced from the leading edge in a chordwise direction;

first and second airfoil halves extending between the airfoil tip and the airfoil root; and a first locally-thickened region, a second locally-thickened region, and a third locally-thickened region formed in the first airfoil half, the first locally-thickened region defined at the airfoil root, wherein a maximum thickness of each chord of the first airfoil half between the airfoil root and the airfoil tip transitions toward the leading edge between the first locally-thickened region and the second locally-thickened region, transitions toward the trailing edge between the second locally-thickened region and the third locally-thickened region, transitions toward the leading edge within the third locally-thickened region, transitions toward the trailing edge between the third locally-thickened region and the airfoil tip, the third locally-thickened region defined closer to the leading edge than the second locally-thickened region and the first locally-thickened region, the third locally-thickened region extending in the spanwise direction and defined between 40% to 80% of the span, and the second locally-thickened region defined closer to the leading edge than the first locally-thickened region, and wherein a chord line that extends through the third locally-thickened region contains a first local thickness maxima and a second local thickness maxima interspersed with at least two local thickness minima, and the first local thickness maxima is defined by the third locally-thickened region and is greater than the second local thickness maxima.

2. The gas turbine engine airfoil of claim 1 wherein the first airfoil half defines a suction side of the gas turbine engine airfoil, and wherein the second airfoil half defines a pressure side of the gas turbine engine airfoil.

3. The gas turbine engine airfoil of claim 1 wherein the first airfoil half has a first multimodal thickness distribution defined along the chord line, as taken in a cross-section plane extending in the spanwise direction and in a thickness direction perpendicular to the spanwise direction and chordwise direction, and the second airfoil half has a second multimodal thickness distribution, as considered in cross-section taken along the cross-section plane.

4. The gas turbine engine airfoil of claim 3 wherein the second multimodal thickness distribution substantially mirrors the first multimodal thickness distribution.

5. The gas turbine engine airfoil of claim 1 wherein the first airfoil half further has a second multimodal thickness distribution, as taken in cross-section along a section plane extending in chordwise and thickness directions.

6. The gas turbine engine airfoil of claim 5 wherein the second multimodal thickness distribution comprises at least three local thickness maxima interspersed with at least two local thickness minima in the chordwise direction.

7. The gas turbine engine airfoil of claim 3 wherein the cross-section plane extends through a middle portion of the first airfoil half substantially equidistantly located between the leading edge and the trailing edge.

8. A gas turbine engine airfoil, comprising:

an airfoil tip;

an airfoil root opposite the airfoil tip in a spanwise direction, with a span 0% at the root and 100% at the tip;

a leading edge;

a trailing edge spaced from the leading edge in a chordwise direction;

a first airfoil half extending between the airfoil tip and the airfoil root in the spanwise direction, the first airfoil half having a maximum thickness that varies in both the chordwise direction and the spanwise direction;

a first locally-thickened region having a first maximum thickness at the root;

a second locally-thickened region having a second maximum thickness located closer to the leading edge than the first locally-thickened region, the second locally-thickened region extending in the spanwise direction;

a third locally-thickened region having a third maximum thickness located closer to the leading edge than the first locally-thickened region and the second locally-thickened region, the second locally-thickened region located between the first locally-thickened region and the third locally-thickened region, the third locally-thickened region located between 40% to 80% span, and the third locally-thickened region extending in the spanwise direction; and a first locally-thinned region having a minimum thickness, the first locally-thinned region located between the third locally-thickened region and the trailing edge in the chordwise direction, wherein a chord line that extends through the third locally-thickened region contains a first local thickness maxima and a second local thickness maxima interspersed with at least two local thickness minima, and the first local thickness maxima is defined by the third locally-thickened region and is greater than the second local thickness maxima.

9. The gas turbine engine airfoil of claim 8 wherein the first locally-thickened region is located closer to the airfoil root than is the second locally-thickened region.

10. The gas turbine engine airfoil of claim 8 further comprising a second airfoil half integrally formed with the first airfoil half, the second airfoil half having a multimodal thickness distribution different than the first airfoil half.

11. The gas turbine engine airfoil of claim 8 further comprising:

a pressure side extending between the airfoil tip and the airfoil root; and a suction side extending between the airfoil tip and the airfoil root, located opposite the pressure side in a thickness direction, and defined by the first airfoil half.

12. A gas turbine engine airfoil, comprising:

an airfoil tip;

an airfoil root opposite the airfoil tip in a spanwise direction, with a span 0% at the root and 100% at the tip;

a leading edge;

a trailing edge substantially opposite the leading edge in a chordwise direction;

a first airfoil half extending from the leading edge to the trailing edge, the first airfoil half having a first multimodal thickness profile, as considered in cross-section taken along a first cross-section plane extending in a thickness direction perpendicular to the chordwise direction taken along a chord line; and a first locally-thickened region, a second locally-thickened region, and a third locally-thickened region formed in the first airfoil half, the first locally-thickened region defined at the airfoil root and the third locally-thickened region has a crescent-shaped geometry that extends in the spanwise direction, wherein the first multimodal thickness profile extends through the third locally-thickened region and comprises at least three local thickness maxima interspersed with at least two local thickness minima, the at least three local thickness maxima including a first local thickness maxima defined by the third locally-thickened region that is greater than a second local thickness maxima and a third local thickness maxima along the chord line, and a maximum thickness of each chord of the first airfoil half between the airfoil root and the airfoil tip transitions toward the leading edge between the first locally-thickened region and the second locally-thickened region, transitions toward the trailing edge between the second locally-thickened region and the third locally-thickened region, transitions toward the leading edge within the third locally-thickened region, transitions toward the trailing edge between the third locally-thickened region and the airfoil tip, the third locally-thickened region defined closer to the leading edge than the second locally-thickened region, the second locally-thickened region defined closer to the leading edge than the first locally-thickened region, the third locally-thickened region defined between 40% to 80% of the span and the second locally-thickened region extends in the spanwise direction.

13. The gas turbine engine airfoil of claim 12 wherein the first cross-section plane extends in the thickness and spanwise directions; and wherein the first airfoil half further comprises a second multimodal thickness profile, as considered in cross-section taken along a second cross-section plane extending in the spanwise direction and in a thickness direction orthogonal to the thickness and chordwise directions.

14. The gas turbine engine airfoil of claim 1, wherein the third locally-thickened region has a crescent-shaped geometry that extends in the spanwise direction.

15. The gas turbine engine airfoil of claim 8, wherein a maximum thickness of each chord of the first airfoil half between the airfoil root and the airfoil tip transitions from the first locally-thickened region at the root toward the leading edge to the second locally-thickened region, transitions toward the trailing edge from the second locally-thickened region to the third locally-thickened region, transitions toward the leading edge within the third locally-thickened region, and transitions toward the trailing edge before reaching the airfoil tip.

16. The gas turbine engine airfoil of claim 15, wherein the third locally-thickened region has a crescent-shaped geometry.

* * * * *